United States Patent [19]

Clark

[11] 3,948,688

[45] Apr. 6, 1976

[54] MARTENSITIC ALLOY CONDITIONING

[75] Inventor: Joel P. Clark, Plainville, Mass.

[73] Assignee: Texas Instruments Incorporated, Dallas, Tex.

[22] Filed: Feb. 28, 1975

[21] Appl. No.: 554,244

[52] U.S. Cl. ..... 148/11.5 R; 148/11.5 F; 148/32; 148/131

[51] Int. Cl.[2] ..... C22F 1/10

[58] Field of Search ..... 148/2, 11.5 R, 11.5 F, 148/130, 131, 32, 32.5

[56] References Cited

UNITED STATES PATENTS 3,748,197 7/1973 Willson et al. ..... 148/131

*Primary Examiner*—R. Dean

*Attorney, Agent, or Firm*—James P. McAndrews; John A. Haug; Russell E. Baumann

[57] ABSTRACT

A two-stage process for conditioning an annealed martensitic alloy of titanium and nickel to improve its service life and provide enhanced elongation activity under high operating stress. In the first stage of the process, the alloy is maintained under a tensile stress sufficient to strain it beyond its plastic yield point while it is repeatedly thermally cycled in a primary temperature range between a lower temperature limit below the temperature at which conversion of martensite to austenite commences on heating and an upper temperature limit at least about equal to the temperature at which essentially all the martensite is converted to austenite on heating. In the second stage of the process, the alloy is maintained at a tensile stress sufficient to strain it beyond its plastic yield point while it is repeatedly thermally cycled in a secondary temperature range between a lower temperature limit equal to or higher than the temperature at which conversion of martensite to austenite commences on heating and an upper temperature limit equal to or lower than the temperature at which conversion of austenite to martensite commences on cooling. A novel product having enhanced service life and elongation activity is obtained.

10 Claims, 3 Drawing Figures

MARTENSITIC ALLOY CONDITIONING

BACKGROUND OF THE INVENTION

This invention relates to martensitic memory alloys and, more particularly, to conditioning an annealed martensitic nickel/titanium alloy to improve its service life and elongation activity under high tensile stress operating conditions.

Alloys of nickel and titanium in which the two elements are present in roughly the same molar proportions have been demonstrated to have martensitic memory properties rendering them highly useful in control devices and other services in which temperature actuation is desirable. When placed under stress, an alloy roughly corresponding to the formula NiTi undergoes a martensitic phase transformation in a relatively narrow temperature range with a resultant change in dimension. This dimensional change is negative with respect to temperature. Thus, if an NiTi wire is under tension and is cooled from a temperature above the martensitic transformation range, it will elongate when a critical temperature range is reached. Conversely, when the wire is heated from a temperature below the martensitic range, it will shorten in a temperature range in which the phase transformation is reversed.

In such thermal cycling of the wire there is a hysteresis effect in that the major share of the reverse transformation takes place in a temperature range somewhat higher than the temperatures at which the major share of elongation takes place. This phenomenon is illustrated in FIG. 1. Thus, on cooling, conversion of austenite to martensite commences at a temperature designated $M_s$ and conversion to martensite is essentially complete at a temperature designated $M_f$. On heating, conversion of martensite beings at a temperature $A_s$ ($A_s>M_f$) and conversion to austenite is complete at a temperature designated $A_f$ ($A_f>M_s$). The phase transformation associated with elongation is accompanied by the release of heat energy and the reverse transformation is accompanied by an absorption of heat.

Because of their unique property of elongating and reversibly foreshortening over a relatively narrow temperature range, martensitic memory alloys, such as nickel/titanium, have found application as thermostatic elements in control devices and as means for the conversion of heat energy to mechanical energy in devices for performing work. Where the alloy is in the form of a thin wire, for example, it may be very rapidly heated or cooled to cause sharp changes in dimension. The practical utility of such a device is enhanced by the extent of this change in dimension. The martensitic elongation activity of these alloys, defined as the ratio of change in length to length ($\Delta L/L$) expressed as a percentage, may range range as high as 2–6%.

A feature of nickel/titanium martensitic alloys which may tend to limit their practical utility is the propensity for their martensitic transformation temperature ranges to be near room temperature. As a consequence, the alloy may undergo phase transformations and resultant elongations and foreshortenings due to ambient variations alone. The effective transformation temperature range of such alloys can be altered, however, by placing the alloy under stress. Thus, for example, if a nickel/titanium alloy wire is placed under a relatively high tension, the temperature ranges over which the phase transformation takes place may be increased by 70° C. or more. The general character of the elongation versus temperature curve remains similar to that deposited in FIG. 1 but the ranges over which austenite/martensite transformations occur are displaced to the right if plotted as in FIG. 1. When cycling under stress, the temperature at which conversion of austenite to martensite begins is designated as $M_d$ rather than $M_s$, and the temperature at which conversion to austenite begins is designated as $A_d$ rather than $A_s$.

Although stress is known to be effective in raising the temperature ranges over which martensite/austenite transformations occur, the feasibility of realizing substantial increases in the operating temperature of a nickel/titanium device may be limited by the tensile strength of the alloy, by the service life of the alloy at high tensile stress, and the effect of high tensile stress in reducing the elongation activity of the alloy. Additionally, the application of high tensile stress may cause the alloy to creep at elevated temperatures or undergo progressive elongation with repeated cycling under service operating conditions.

A number of processes have been proposed for conditioning nickel/titanium martensitic alloys with the purpose of improving their operating characteristics. Thus, for example, Willson et al. U.S. Pat. No. 3,652,969 describes a process in which the stability of a nickel/titanium control element is improved by repeatedly cycling it through its martensitic transformation range at a load greater than the load to be utilized in service. Thus, Willison et al. describe cycling the element under a stress of 40,000 psi where the service load is 20,000 psi. This process, however, relates to relatively low strength alloys and is, therefore, not directed to the problem of increasing service life and maintaining elongation activity under very high tensile stresses in the range of 175,000 psi or greater.

Wang, *Journal of Applied Physics*, Vol. 44, No. 7, July 1973, p. 3013, describes a method by which the repeatability of a martensitic alloy is improved by cycling it partially through its transformation range, while maintaining it under a tensile stress just sufficient to deform the material to the limit of its easy plastic flow region. For a typical nickel/titanium alloy comprising on the order of 54.3% by weight nickel, annealed in accordance with the method described in my copending application Ser. No. 427,164, such stress would be on the order of 85,000 psi. However, Wang's object is merely to enhance the reversibility of the alloy transformations and the Wang method is not directed to improved service life or maintenance of high elongation activity under extra high tensile stresses.

In my aforesaid copending application, I have described a process for increasing the tensile strength of a martensitic alloy of titanium and nickel by maintaining the alloy under a tensile stress of between about 30,000 and about 100,000 psi, while annealing it at a temperature above a first diffusional phase transformation temperature. This process is effective not only to increase the tensile strength of the alloy but to stabilize it against progressive elongation even under severe operating conditions, and to maintain its elongation activity at a level of at least about 2% at high tensile stress. The product of the annealing process of the aforesaid application is highly satisfactory for many practical uses. A need has remained, however, for further improvement in the service life of the alloy under high tensile stress conditions, and for further improvement in elongation activity.

SUMMARY OF THE INVENTION

It is an object of the present invention to provide a process for increasing the service life of a high strength nickel/titanium alloy under high tensile stress operating conditions. It is a further object of the present invention to provide such a process which also enhances the elongation activity of the alloy under high tensile stress operating conditions. A further object of the invention is to provide an improved nickel/titanium alloy product suitable for use in control and/or work performance devices. Other objects and features will be in part apparent and in part pointed out hereinafter.

Briefly, therefore, the present invention is directed to a process of conditioning an annealed martensitic alloy of titanium and nickel to improve its service life and provide enhanced elongation activity under high operating stress. In this process, the alloy is maintained under a tensile stress sufficient to strain it beyond its plastic yeild point, while it is repeatedly thermally cycled in a primary temperature range between a lower temperature limit below the temperature at which conversion of martensite to austenite commences on heating and an upper temperature limit at least about equal to the temperature at which essentially all the martensite is converted to austenite on heating. Thereafter, the alloy is maintained at a tensile stress sufficient to strain it beyond its plastic yield point, while it is repeatedly thermally cycled in a secondary temperature range between a lower temperture limit equal to or higher than the temperature at which conversion of martensite to austenite commences on heating and an upper temperature limit equal to or lower than the temperature at which conversion of austenite to martensite commences on cooling.

BRIEF DESCRIPTION OF THE DRAWINGS

Corresponding reference characters indicate corresponding parts through the several views of the drawings.

DESCRIPTION OF PREFERRED EMBODIMENTS

In accordance with the present invention, it has been discovered that the service life of a nickel/titanium martensitic alloy element may be materially improved if the annealed alloy is subjected to a two-stage thermal cycling schedule while it is maintained under very high tensile stress sufficient to strain the alloy beyond its plastic yield point. In the first stage of this process, the alloy is subjected to a relatively severe thermal cycling over a wide primary temperature range extending from a temperature below the onset of martensite to austenite transformation ($A_d$) to an upper limit essentially equal to the temperature of complete conversion to austenite ($A_f$) or beyond. In the second stage, which is normally carried through a substantially greater number of cycles than the first, the alloy is thermally cycled in a narrower secondary range, entirely within the martensitic transformation range. The lower limit of the secondary range is the temperature characterized by the onset of austenite formation on heating ($A_d$) and the upper limit of the secondary range is the temperature at which martensite formation commences on cooling ($M_d$). Certain beneficial structural changes are initiated in the alloy during the first stage of the process, while the second stage effects further development of desirable alloy properties. The relative narrowness of the secondary range allows maximum development of desirable properties under less severe conditions than those imposed by the primary range which would lead to alloy failure over the relative large number of cycles preferred in the second stage of the process. This process not only contributes to markedly improved service life, but also enhances the elongation activity of the alloy when operated under high tensile stress conditions.

Figure 3:
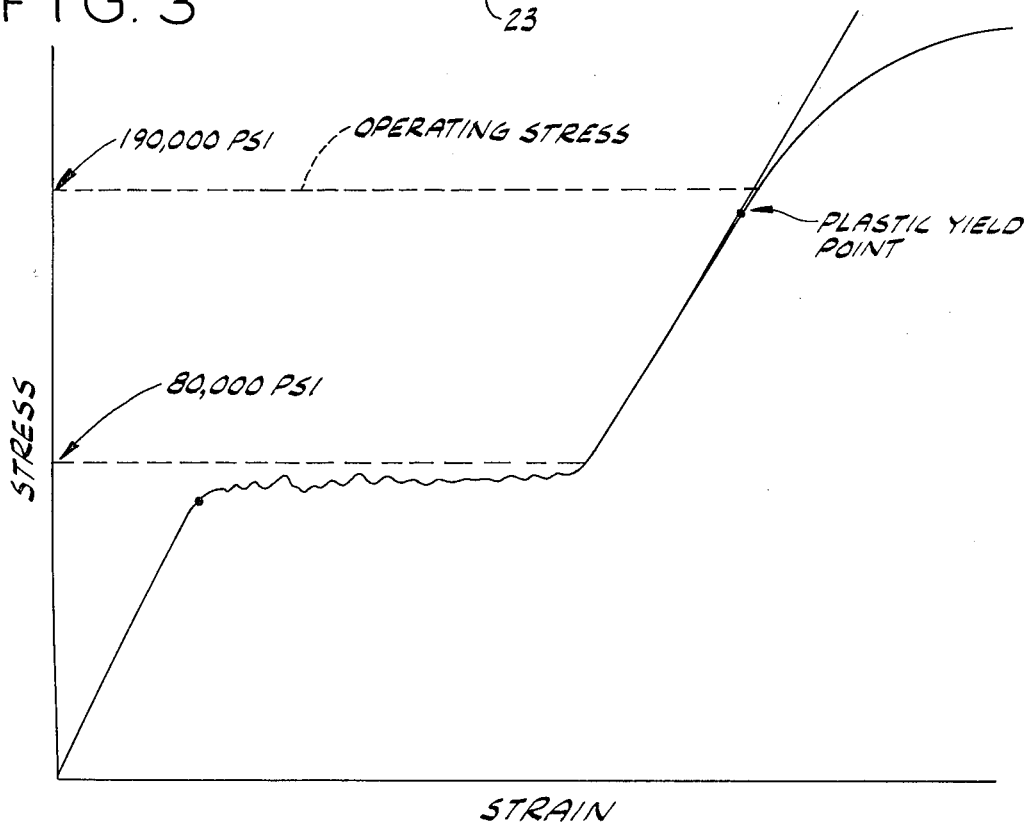
FIG. 3 is a stress/strain curve for a tension-annealed alloy consisting of 54.3% by weight nickel and the balance titanium. Indicated on this curve is the plastic yield point of the alloy.

The purpose and result of the process of the invention differ from that of the method described in Willson et al. U.S. Pat. No. 3,652,969 which is concerned only with repeatability and avoidance of progressive elongation, while the process of this invention provides both increased service life and enhanced elongation activity. Although Willson et al. teach a process in which the alloy is cycled through its martensitic transformation range at a tensile stress in excess of the stress for which the processed martensitic memory alloy element is designed, the Willson et al. process involves only a single stage. Willson et al. do not describe or contemplate the second stage of the process of this invention in which the alloy is cycled in a defined range entirely within its martensitic transformation range. Wang, in his above-cited publication, describes a method in which a martensitic alloy is cycled within its martensitic transformation range but, as noted above, Wang applies a relatively low tensile stress during the course of the thermal cycling. Thus, Wang employs a tensile stress only sufficient to deform the alloy to the limit of its easy plastic flow region which, as indicated in FIG. 3, may be on the order of 80,000–85,000 psi for an alloy consisting of 54.3% by weight nickel and a balance of titanium which has been tension-annealed in accordance with the method described in the aforesaid application Ser. No. 427,164. In the process of this invention, by contrast, the tensile stress applied is sufficient to deform the alloy beyond its plastic yield point. For an alloy having the stress/strain curves of FIG. 3, therefore, the process of the invention employs a tensile stress on the order of 190,000 psi or higher. Further, of course, Wang does not disclose the first stage of the process of the invention in which the alloy is cycled over a wide temperature range extending to about $A_f$, or higher. Wang's objective, moreover, differs from the objects of the present invention since Wang is concerned with inducing reversible behavior in the alloy, while the process of the invention affords increased service life and enhanced elongation activity at high operating tensile stresses.

Nickel/titanium alloys useful in martensitic memory devices are generally equimolar with regard to nickel and titanium content. Thus, the nickel content of the alloy may range between about 50% and 58% by weight with the balance of the alloy being essentially titanium. Such alloys are normally formed as a wire for use in a martensitic transformation actuated device, and a wire is the form in which they are most conveniently subjected to the method of the invention. The necessary tensile stress may be imposed on the wire by connecting it to a fixed restraint at one point along its length and loading it with a weight or spring at another point along its length.

Figure 1:
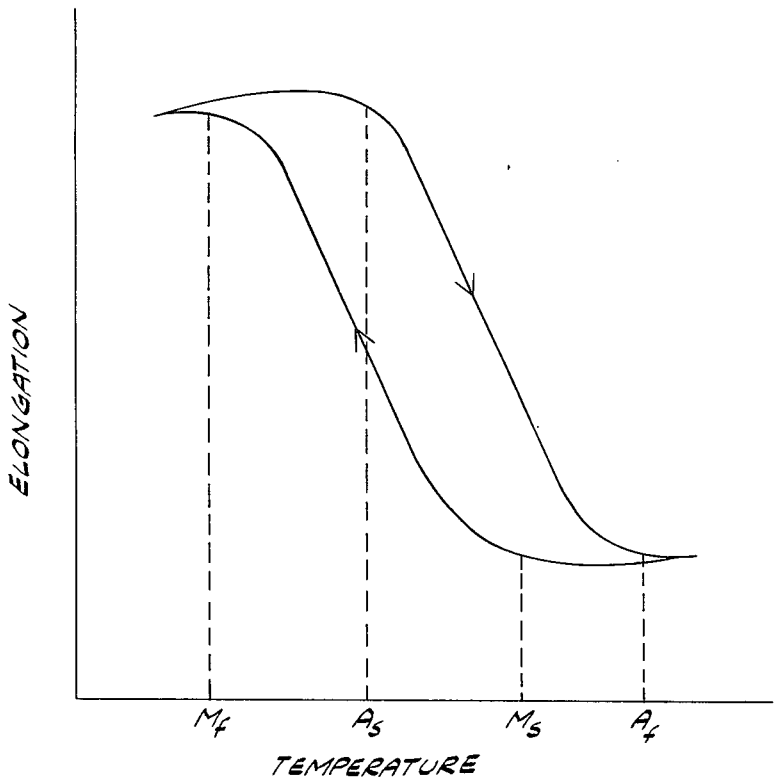
FIG. 1 is a plot of elongation versus temperature illustrating the operation of a martensitic memory alloy.
Figure 2:
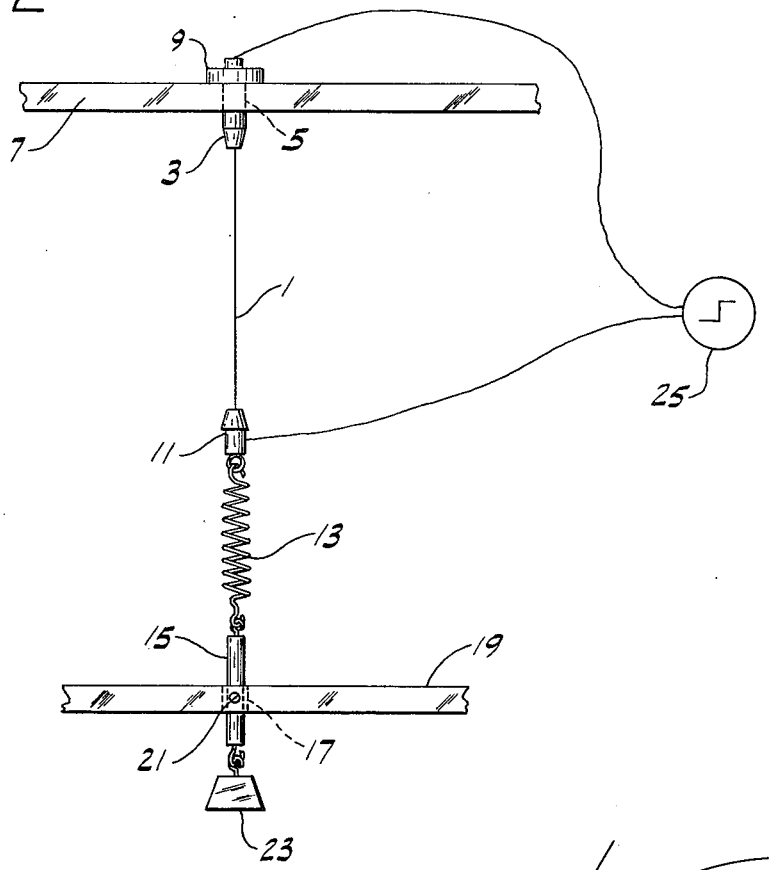
FIG. 2 is a schematic illustration of an apparatus that may be utilized in carrying out the process of the invention.

FIG. 2 depicts an apparatus useful in conducting the process of the invention. Shown at 1 is a martensitic memory alloy wire suspended from and electrically connected to a chuck 3 whose upper end passes through an aperture 5 in a beam 7 and is supported by the beam by means of a chuck retainer 9. The connection between chuck 3 and retainer 9 is electrically conductive. The end of wire 1 opposite chuck 3 is connected through a chuck 11 to a spring 13, which has a predetermined spring constant. An aluminum rod 15 is hung from spring 13 and passes through an aperture 17 in a lower constraint member 19. A set screw 21 threadably engaged in an aperture 17 of member 19 adjustably secures rod 15 in a fixed position. A weight 23 is hung from the lower end of rod 15. The ends of wire 1 are electrically connected to opposite terminals of a square wave electrical generator 25 through chuck retainer 9 and chuck 11, respectively.

In carrying out the process of the invention, a weight 23 sufficient to exert the necessary tensile stress on wire 1 is hung from rod 15. The proper stress level is achieved by selection of a weight of such mass that the ratio of the gravity force exerted by the weight to the cross-sectional area of wire 1 is such that the wire is strained beyond its plastic yield point. After spring 13 has been extended in response to the gravity force of weight 23, the assembly of spring 13 and rod 15 is locked in position by set screw 21 whereupon weight 23 is removed, and the proper stress thereafter maintained on the wire by the spring. Application of current to the wire by square wave generator 25 causes thermal cycling of the alloy due to resistance heating and ambient cooling.

Before it is subjected to conditioning in accordance with the process of the invention, the martensitic alloy is annealed. Preferably, annealing is carried out under high tensile stress using the method described in my aforesaid copending and coassigned application Ser. No. 427,164. This annealing process not only increases the tensile strength of the alloy but provides a relatively high elongation activity under stress, an elongation activity which is further enhanced by the conditioning method of the invention.

In the first (or primary) conditioning stage, the annealed alloy is subjected to a tensile stress beyond its plastic yield point and thermally cycled in a primary temperature range by application of a square wave ON/OFF current having a sufficient current density and ON time to heat the alloy to a temperature at which conversion of martensite to austenite is essentially complete ($A_f$), or higher, and a sufficient OFF period to allow ambient cooling to a temperature below the temperature at which conversion of martensite to austenite commences on heating ($A_d$). Cycling in this temperature range is continued until an appreciable elongation of the alloy wire has ceased. Typically, 20–100 cycles in the primary temperature range are sufficient. In this first stage of the conditioning method, growth is realized in the martensitic variants having the most compatible orientation to the applied stress. Motion also occurs in the twin boundaries which results in a more favorable orientation of these boundaries to the applied stress, and the defect structure at the martensite/austenite interface is built up.

In the second stage of this conditioning method, the alloy is maintained under a high stress beyond its plastic yield point and again thermally cycled by application of an ON/OFF square wave current pulse. The frequency of the pulse is preferably controlled so that the ON time and OFF time are both in the range of between about 0.1 and about 0.5 seconds. The current density at the plateau of the square wave is sufficient to heat the wire from a minimum temperature equal to or above the temperature at which conversion of martensite to austenite commences on heating ($A_d$) to a maximum temperature which is equal to or below the temperature at which conversion of austenite to martensite commences on cooling ($M_d$). Preferably, the secondary temperature range is sufficiently wide so that at least 25% by volume of the alloy is subjected to austenite/martensite conversion in each cycle. Typically, the upper limit of the secondary range may be 150°–200° F. above the lower limit. Cycling in the secondary range improves the service life and elongation activities of the alloy by increasing the twinned density in the direction of the wire axis without the continued buildup in defect structure associated with the primary temperature range, a buildup which would lead to failure of the alloy during processing before the optimum alloy properties are realized. The desired optimization of alloy properties is achieved in approximately 1,000–10,000 cycles in the secondary range.

The product of the invention is a high strength nickel/titanium alloy adapted for extended use in high tensile stress applications. The alloy is characterized not only by a long service life but by enhanced elongation activity as compared to a similar alloy which has not been conditioned in accordance with the process of the invention. Elongation activity is generally increased by about 10%. Thus, for example, an alloy which has been annealed in accordance with the method described in my copending application Ser. No. 427,164, may have an elongation activity of about 2.0% at a constant stress of 100,000 psi. After conditioning in accordance with the process of the invention, the elongation activity at 100,000 psi would be increased to about 2.2%.

The following example illustrates the invention.

EXAMPLE

Using an apparatus of the type depicted in FIG. 2, a 0.002 inch diameter wire constituted of a tension-annealed alloy comprising 54.3% by weight nickel and the balance essentially titanium (having a stress/strain curve similar to FIG. 3) was placed under a tensile load of 190,000 psi. On heating a wire of ths composition under this load, martensite to austenite transformation beings at about 160° F. ($A_d$) and is complete at about 540° F. ($A_f$). On cooling, the transformation begins at about 380° F. ($M_d$) and ends at about 0° F. ($M_f$).

A square wave ON/OFF current pulse was passed through the wire using a current density during ON periods sufficient to heat the wire to about 540° F. with OFF periods of sufficient duration to cool it to 75° F. Cycling was continued for a total of 100 cycles.

In order to thermally cycle a wire in the secondary temperature range in accordance with the second stage of the process of the invention, the wire was maintained under a tensile load of 190,000 psi and a square wave ON/OFF current pulse was applied having an ON current density of 65 ma for a 0.25 sec. ON period. The OFF period was also 0.25 sec. Application of this current caused the wire to thermally cycle between about 180° F. and about 380° F. Second stage processing was carried on through a total of 5,000 cycles.

After conditioning was complete, the wire was removed from the conditioning apparatus and tested for elongation activity. At a tensile load of 100,000 psi, the elongation activity was found to be approximately 2.2%. The wire was then subjected to a fatigue test by repeatedly cycling it over a wire temperature range of 75° to 300° F. under a constant tensile load of 115,000 psi in a room temperature environment. The wire survived 100,000 thermal cycles without failure and retained its 2.2% activity.

In view of the above, it will be seen that the several objects of the invention are achieved and other advantageous results attained.

As various changes could be made in the above methods and products without departing from the scope of the invention, it is intended that all matter contained in the above description or shown in the accompanying drawings shall be interpreted as illustrative and not in a limiting sense.

What is claimed is:

1. A process for conditioning an annealed martensitic alloy of titanium and nickel to improve its service life and provide enhanced elongation activity under high operating stress, the process comprising the steps of:

maintaining the alloy under a tensile stress sufficient to strain it beyond its plastic yield point while repeatedly thermally cycling the alloy in a primary temperature range between a lower temperature limit below the temperature at which conversion of martensite to austenite commences on heating and an upper temperature limit at least about equal to the temperature at which essentially all the martensite is converted to austenite on heating; and thereafter maintaining the alloy at a tensile stress sufficient to strain it beyond its plastic yield point while repeatedly thermally cycling the alloy in a secondary temperature range between a lower temperature limit equal to or higher than the temperature at which conversion of martensite to austenite commences on heating and an upper temperature limit equal to or lower than the temperature at which conversion of austenite to martensite commences on cooling.

2. A process as set forth in claim 1 wherein the difference between the lower temperature limit and the upper temperature limit in said secondary range is sufficient that at least 25% by volume of the alloy is subjected to austenite/martensite conversion in each cycle.

3. A process as set forth in claim 1 wherein said alloy comprises approximately 54.3% by weight nickel and the balance essentially titanium.

4. A process as set forth in claim 3 wherein said alloy is tension-annealed prior to conditioning and is maintained under a tensile stress of at least about 180,000 psi during thermal cycling.

5. A process as set forth in claim 4 wherein the alloy is in the form of a wire which is thermally cycled by subjecting it to alternate resistance heating and ambient cooling.

6. A process as set forth in claim 5 wherein the alloy is thermally cycled in said secondary temperature range by application of square wave current pulses.

7. A process as set forth in claim 6 wherein the ON time of the current pulse is between about 0.1 and 0.5 seconds and the OFF time is between about 0.1 and 0.5 seconds.

8. A process as set forth in claim 7 wherein the wire has a diameter on the order of 0.002 in. and is subjected to square wave current pulses with an average maximum current of about 65 ma with an ON time of approximately 0.25 seconds and an OFF time of approximately 0.25 seconds.

9. A process as set forth in claim 1 wherein the alloy is in the form of a wire and is subjected to tensile stress by connecting it to a fixed restraint at one point along its length and loading it with a spring at another point along its length.

10. An annealed martensitic alloy of titanium and nickel having an extended service life and high elongation activity under high operating stress prepared by:

maintaining the annealed alloy under a tensile stress sufficient to strain it beyond its plastic yield point while repeatedly thermally cycling the alloy in a primary temperature range between a lower temperature limit below the temperature at which conversion of martensite to austenite commences on heating and an upper temperature limit at least about equal to the temperature at which essentially all the martensite is converted to austenite on heating; and thereafter maintaining the alloy at a tensile stress sufficient to strain it beyond its plastic yield point while repeatedly thermally cycling the alloy in a secondary temperature range between a lower temperature limit equal to or higher than the temperature at which conversion of martensite to austenite commences on heating and an upper temperature limit equal to or lower than the temperature at which conversion of austenite to martensite commences on cooling.

* * * * *